US005511494A

United States Patent [19]

Scott

[11] Patent Number: 5,511,494

[45] Date of Patent: Apr. 30, 1996

[54] TRANSACTION DEAL DRAWER

[75] Inventor: Lowell Scott, Fairfield, Ohio

[73] Assignee: Hamilton Safe Company, Fairfield, Ohio

[21] Appl. No.: 219,225

[22] Filed: Mar. 28, 1994

[51] Int. Cl.[6] ..... E06B 7/32

[52] U.S. Cl. ..... 109/19; 109/66; 108/137; 312/334.1

[58] Field of Search ..... 108/137; 312/334.27; 109/10, 19, 22–24, 39–43, 45, 47, 50, 58, 66, 73

[56] References Cited

U.S. PATENT DOCUMENTS

| | | | |
|---|---|---|---|
| 884,457 | 4/1908 | Boydelatour . | |
| 1,654,692 | 1/1928 | Marois | 109/19 |
| 1,733,107 | 10/1929 | Ahlberg | 108/137 |
| 1,733,131 | 10/1929 | Ong . | |
| 1,926,503 | 9/1933 | Straubel | 129/26 |
| 2,048,195 | 7/1936 | Murtaugh | 109/1 |
| 2,455,154 | 11/1948 | Bailey | 312/174 |
| 2,730,053 | 1/1956 | Ellithorpe | 109/19 |
| 2,896,748 | 7/1959 | McClintock | 109/19 |
| 2,914,244 | 11/1959 | Wheeler | 109/19 X |
| 3,077,243 | 2/1963 | Buros | 109/19 X |
| 3,145,918 | 8/1964 | Higgins et al. | 109/19 X |
| 3,682,113 | 8/1972 | McClellan et al. | 109/19 |
| 3,880,345 | 4/1975 | Becker | 109/19 X |
| 4,157,071 | 6/1979 | King | 109/19 |
| 4,393,789 | 7/1983 | Glotfelter | 109/19 |
| 4,429,639 | 2/1984 | Burchart | 109/19 |
| 4,483,255 | 11/1984 | Collier, Jr. et al. | 109/66 |
| 4,635,763 | 1/1987 | Omata | 188/268 |
| 4,720,154 | 1/1988 | Seiter | 109/24.1 |
| 4,747,354 | 5/1988 | Fee et al. | 109/66 X |
| 4,819,570 | 4/1989 | Bailet | 109/23 |

FOREIGN PATENT DOCUMENTS

| | | | |
|---|---|---|---|
| 618555 | 4/1961 | Canada | 109/19 |
| 1021226 | 2/1953 | France | 109/19 |
| 1708492 | 4/1970 | Germany | 109/19 |
| 1808371 | 5/1970 | Germany | 109/19 |
| 526446 | 3/1955 | Italy | 108/137 |
| 383607 | 1/1965 | Switzerland | 109/19 |

*Primary Examiner*—Steven N. Meyers
*Assistant Examiner*—Suzanne L. Dino
*Attorney, Agent, or Firm*—Beveridge, DeGrandi, Weilacher & Young

[57] ABSTRACT

A transaction drawer for efficiently converting the rotational motion of a carrier supporting structure into linear motion of the carrier. The carrier supporting mechanism has a first arm which is supported on a base of the drawer frame, and which pivots about the base. The first arm is pivotably connected to a second arm, which is in turn pivotably connected to the carrier. The second arm and the base are connected by a first transmission assembly, which rotates the second arm about the first arm in response to the first arm's rotation about the base. The first arm and the carrier are connected by a second transmission assembly, which rotates the carrier about the second arm in response to the second arm's rotation about the first arm. The first and second transmission assemblies cooperate to maintain the carrier at a constant angular position relative the drawer frame.

27 Claims, 6 Drawing Sheets

TRANSACTION DEAL DRAWER

BACKGROUND OF THE INVENTION

Typically, transaction drawers such as bank drawers are designed to slide back and forth along a line, much like conventional drawers, such as furniture drawers. Generally, these transaction drawers slide on a rail, and, if the drawer is to be extended over any substantial length, the rail is arranged in multiple stages which must telescope into each other.

Another approach to a transaction drawer involves pivotable arms rather than rails for extension and retraction of the transaction drawer carrier. For example, U.S. Pat. No. 4,429,639 to Burchart discloses a dispenser for a safe which uses the rotation motion of two arms to move a drawer in a linear direction. The first arm is pivotably connected to a second arm, which is pivotably connected to the drawer. As the first arm pivots about the shaft of a driving motor, it pulls the second arm, which in turn pulls the drawer. Passive guide means, separate from the arms, maintain the drawer fixed on a linear path. While the drawer of this device converts rotational motion into linear motion, its range of motion is limited to twice the length of the first arm. The second arm does not contribute to the range of motion of the drawer.

SUMMARY OF THE INVENTION

The present invention relates to a drawer mechanism which most efficiently converts the rotational motion of a carrier supporting structure into linear motion of the carrier of the drawer mechanism. With the drawer of the present invention, the carrier is maintained at a constant angular position throughout its extension and retraction, while efficiently using each of the rotating arms of the drawer mechanism to extend the range of motion of the carrier. In a preferred embodiment, the full length of each of two arms determines the extent to which the carrier will travel.

One object of the invention is to provide a drawer which has a first arm supported on a base for swinging movement about a first axis which is stationary with respect to the base. A second arm is supported on the first arm for swinging movement about a second axis, which is stationary with respect to the first arm, and which is substantially parallel to the first axis. A carrier is supported on the second arm for pivotal movement about a third axis which is stationary with respect to the second arm, and which is substantially parallel to the second axis. The drawer mechanism of the present invention also includes a first drive means for controlling the angular position of the second arm relative to the first arm in response to swinging movement of the first arm relative to the base. It includes a second drive means for controlling the angular position of the carrier relative to the second arm in response to swinging movement of the second arm relative to the first arm. The angular positions have magnitudes and directions which maintain the carrier at a fixed angular orientation relative to the base, throughout the swinging movement of the arms.

Another object of the invention is to provide a drawer having a base, a carrier which is supported on the base and movable relative to the base from a retracted position to an extended position, and a plurality of arms which support the carrier on the base. The arms are pivotally connected together in series, and include at least a base arm and a carrier arm. In one embodiment of the drawer of the present invention, the base arm is supported on the base for swinging movement about a first axis which is stationary on the base. The carrier arm includes means for supporting the carrier for pivotal movement about a carrier pivot axis, which is stationary on the carrier arm and which is parallel to the first axis. This embodiment of the drawer of the present invention also includes position controlling means for maintaining the carrier axis in a reference plane, throughout the movement of the carrier from its retracted position to its extended position. The reference plane is stationary with respect to the base and is defined by the first axis and the carrier axis. With this position controlling means, a base gear is included, which base gear is concentric with the first axis and is originally fixed to the base. This position controlling means also includes a carrier gear which is concentric with the carrier pivot axis and which is rigidly fixed to the carrier, and transmission means, connecting the base gear to the carrier gear, for rotating the carrier gear in response to pivotal movement of the arms to maintain the carrier at a constant orientation relative to the reference plane.

Also, the present invention provides a transaction drawer mechanism that comprises a frame that includes a base portion and a carrier which has a retracted position wherein the carrier is secure within the frame, and which is extendible from the frame. A first arm is supported on the base portion for swinging movement about a first axis which is stationary with respect to the base. A second arm is supported on the first arm for swinging movement above a second axis, which is stationary with respect to the first arm; the second arm is spaced from the first axis and substantially parallel to the first axis. The carrier is supported on the second arm for pivotal movement about a third axis which is stationary with respect to the second arm, spaced from the second axis, and substantially parallel to the second axis. The drawer mechanism further comprises first drive means for controlling the angular position of the second arm relative to the first arm in respect to swinging movement of the first arm relative to the base portion, and second drive means for controlling the angular position of the carrier relative to the second arm in response to swinging movement of the second arm relative to the first arm, such that the angular positions have magnitudes and directions which maintain the carrier at a fixed angular orientation relative to the base portion and the frame throughout the swinging movement of the arms.

BRIEF DESCRIPTION OF THE DRAWINGS

Further aspects and features of the present invention will be even more apparent from the following detailed description and drawings, and the appended claims. In the drawings:

DETAILED DESCRIPTION OF THE PREFERRED EMBODIMENTS OF THE INVENTION

Figure 1:
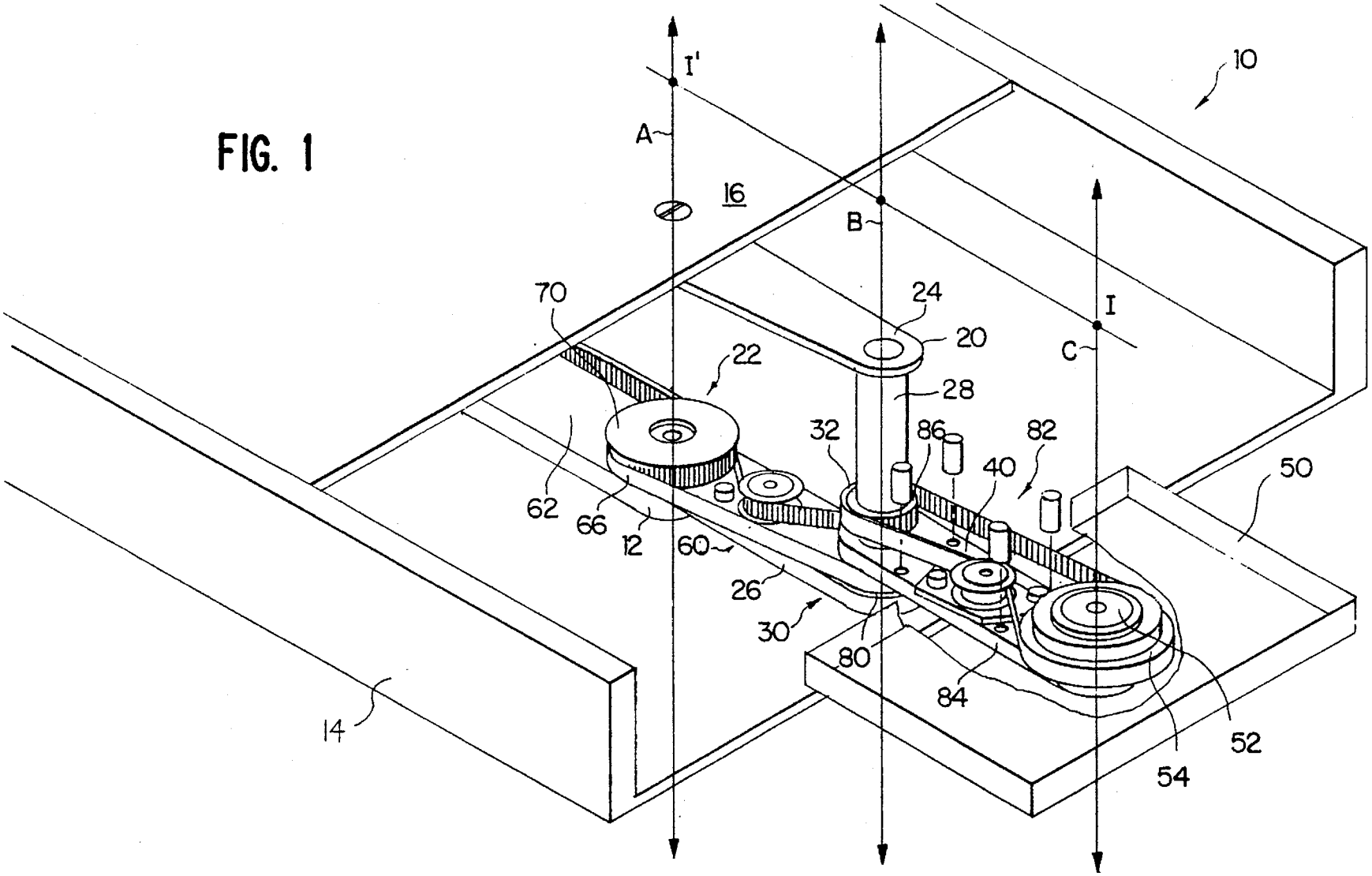
FIG. 1 is a perspective view of a transaction drawer mechanism equipped in accordance with the present invention.
Figure 2:
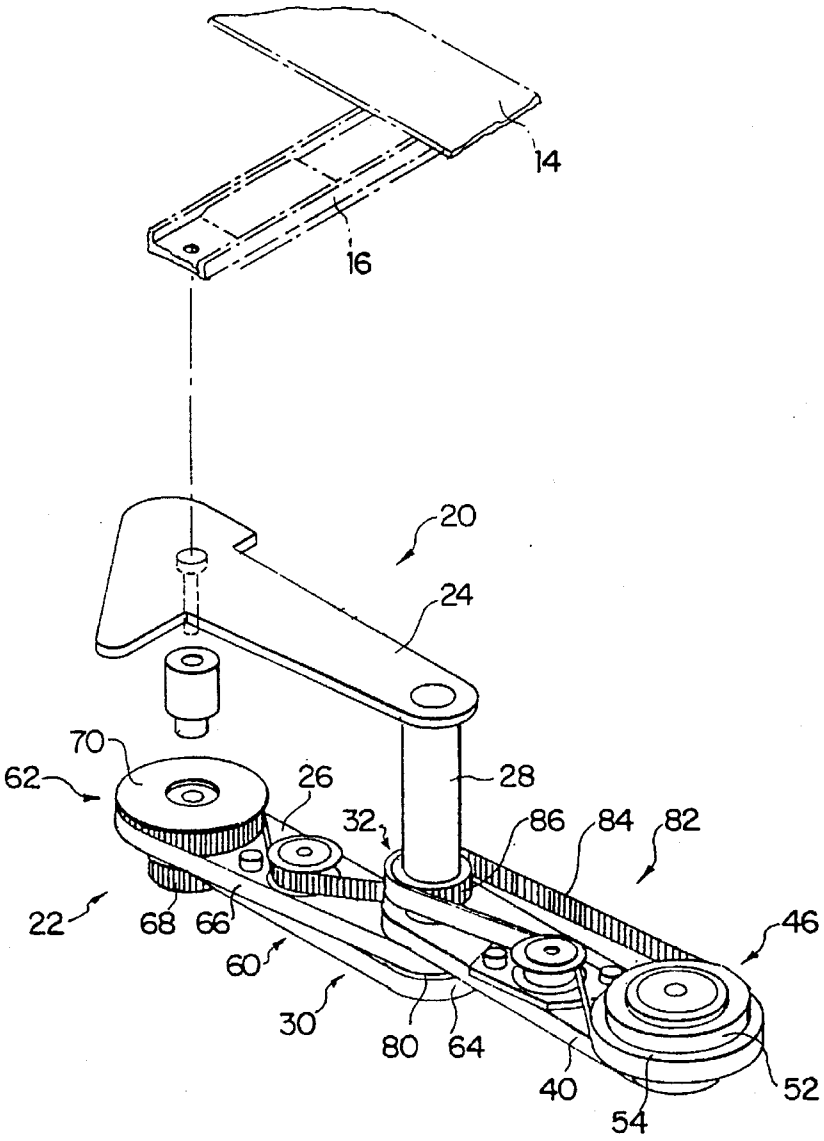
FIG. 2 is an enlarged perspective view of the pivotable arms and drive assemblies of the transaction drawer mechanism of FIG. 1.

Reference will now be made to the drawings, wherein like parts are designated with like reference numerals throughout. FIG. 1 illustrates a preferred embodiment of the transaction drawer mechanism 10 in accordance with the present invention. Reference will be made to both FIG. 1, and to FIG. 2 which is an exploded view of the embodiment of FIG. 1. This embodiment is ideally suited as a transaction drawer for use such as in "drive-up" type bank teller stations, "self-serve" gas stations and the like.

Transaction drawer assembly 10 has a drawer frame 14 provided with a base 12. It is preferred that drawer frame 14 be a rectangular, metallic structure with suitable strength to provide security as a cash transaction drawer in, as mentioned, a conventional "drive-up" teller window. However, any frame which will perform the necessary functions of a drawer frame may also be used.

This drawer assembly 10 has a first arm 20 which is pivotally connected to the base 12 at a first end portion 22 of the first arm. This first arm 20 includes an upper portion 24, a lower portion 26, and a connecting rod 28 which joins the upper portion and the lower portion to define a U-shaped form for the arm. The upper portion 24 of the first arm is rotatably mounted to the frame at a crossover structure 16 thereof. Meanwhile, the lower portion 26 of the first arm is rotatably mounted to the base 12, directly under the location at where the upper portion 24 is connected to the frame crossover 16. Both the upper portion 24 and the lower portion 26 may be rotatably mounted with conventional mounting means, such as a nut and bolt assembly, or any other journaling arrangement known to those of ordinary skill in the art. Because the upper portion 24 of the first arm 20 is rotatably mounted directly over its lower portion 26, the first arm pivots about a first axis A which perpendicularly extends through both first arm 20 end portions 22 and the base 12.

The connecting rod 28 joins the upper portion 24 and the lower portion 26 of the first arm at a second end portion 30, opposite the first end portion 22. Such connection between the upper and lower arm portions 24, 26 with the rod 28 can be integral, or can be carried out in any other conventional way. In this fashion, the upper portion 24, the lower portion 26, and the connecting rod 28 form the U-shape with the opening of the "U" facing the base. Also, the connecting rod 28 provides a second axis B at the second end portion 30 of the first arm, which second axis is parallel to the first axis A at the first end portion 22 of the first arm 20.

Figure 3:
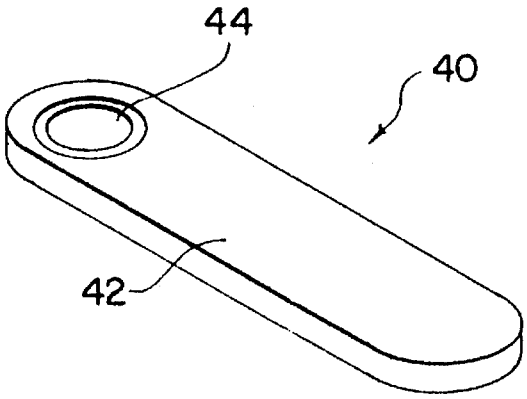
FIG. 3 is a schematic view, in perspective, which shows an exemplary plate suitable for use as the second arm in the mechanism shown in FIGS. 1 and 2.

In the preferred embodiment, a second arm 40 is pivotably connected to the first arm 20 at the connecting rod 28. Such pivotable connection is made at a location above the lower portion 26 of the arm 20, but below a structure which will be referred to at this point as the third gear means 32. In this embodiment, as seen from FIG. 3, the second arm 40 primarily is an elongated metal plate 42 with an opening 44 formed at a first end portion 41 of such plate. Opening 44 also defines the second axis B, which axis is seen as perpendicular to the plane of the second arm plate. The connecting rod 28 of the first arm 20 is received by opening 44, to extend through the second arm 40 and pivotably join the second arm to the first arm. This arrangement thus allows the second arm 40 to rotate about the connecting rod 28 in a plane perpendicular to the second axis B extending through the connecting rod and the opening 44.

The carrier or tray 50 of the drawer assembly 10 of the present invention is pivotably mounted on the second end portion 46 of the second arm 40, opposite the first end portion 41 connected to the first arm 20. The carrier can be of any conventional type and any conventional size and shape, and only need be constructed so as to be sufficient to transport the desired materials, such as documents, currency or coinage.

Preferably the carrier is affixed to an upper portion of a gear structure which will be referred to as the fourth gear means 52 of the mechanism 10. A lower portion of the fourth gear means 52 is fixed to the second arm 40. Fourth gear means upper and lower portions each have bearing surfaces (not shown in detail in FIGS. 1 and 2) which, in the preferred embodiment, are located between the toothed gear 54 of the fourth gear means and second arm 40. This arrangement for the fourth gear means 52 allows the fourth gear means upper portion, and the carrier 50, to rotate about a third axis C which is perpendicular to the plane of the second arm 40, and which is parallel to the first and second axes A, B.

Also, in the preferred embodiment, the motion of the first and second arms 20, 40, and the carrier 50, relative to each other and to the base 12, is controlled by two drive assemblies 60, 82, each of which includes a pair of gear means and a transmission belt. More specifically, each drive assembly has two toothed, sprocket-like gears, and the transmission belt which interconnects the two gears for rotational movement. The function and operation of each of drive assemblies 60, 82 will now be explained in more detail.

The first drive assembly 60 includes the first gear structure 62, the second gear structure 64, and first transmission belt 66. This assembly relates rotation of the second arm to rotation of the first arm.

Figure 4:
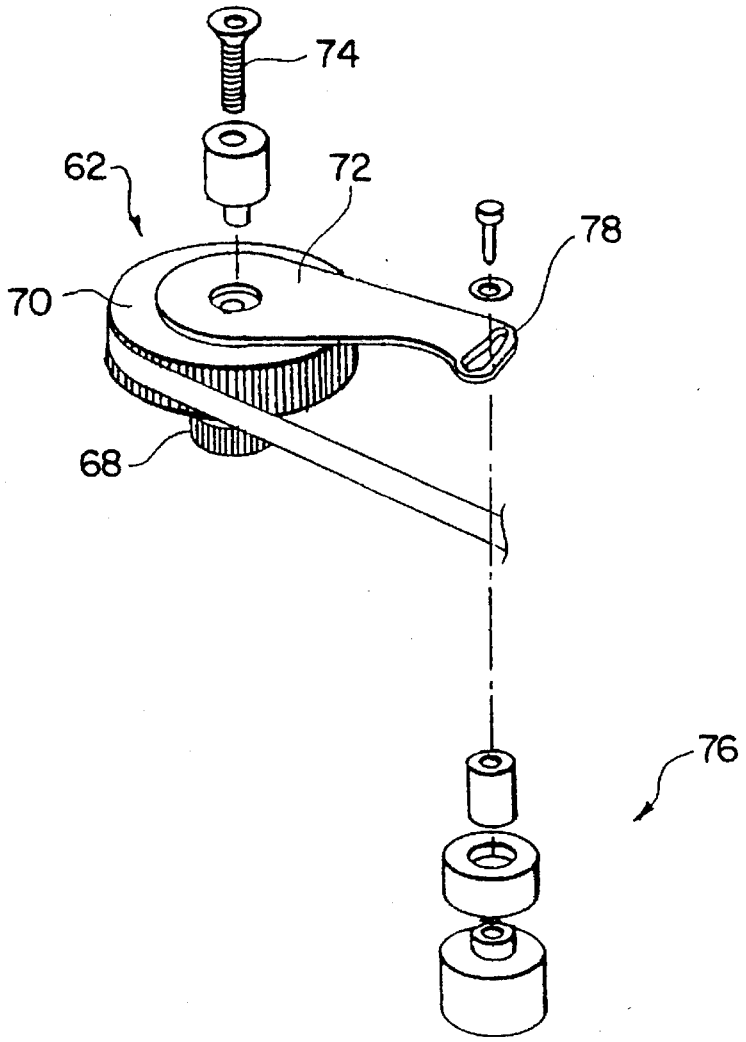
FIG. 4 is a perspective view of a preferred adjustment arm which provides for initial adjustment of the second arm and thereafter rigidly fixes the first gear of the first arm.

The first gear structure 62 includes a lower toothed gear 68, located below the first arm 26, which gear is rigidly fixed to the first arm 26. The function of this lower toothed gear 68 will be described in detail in the following. The first gear structure or means 62 also has an upper toothed gear 70 that is located above the first arm 26 and that is rigidly fixable to the base 12; it also is concentric with respect to the first axis A. With reference also to FIG. 4, in the preferred embodiment of the invention the upper toothed gear 70 is rigidly fixable to the base by an initial adjustment arm 72. One end of such adjustment arm is immovably fastened to the upper gear 70 by conventional fastening means, such a bolt 74. The opposite end of the adjustment arm 72 is selectively, immovably fastened to a mounting arrangement 76 on the base by a bolt or the like which passes through a slot 78 in this end, to anchor this slotted end to the base. The slot 78 allows the position of the adjustment arm 72, and thus the upper gear 70, to be adjusted. As is apparent, this provides adjustment capability for the upper gear 70 to permit initial adjustment of the second arm 40, and ultimately initial adjustment of the angular position of the carrier 50 for proper alignment prior to use. Such a drawer mechanism 10, equipped with adjustment arm 72 compensates for differences in, for example, belt lengths, or other differences in elements which make up the mechanism.

The second gear means 64 of drive assembly 60 is contemplated as formed integrally with the second arm 40 (although other fixed relationships are possible) and is concentric with the second axis B extending through the connecting rod. In the exemplary embodiment, this second gear means 64 is located between the metal plate 42 of the second arm 40 and the lower portion 26 of the first arm 20 as shown. Primarily, it is made up of another toothed gear wheel 80.

The first gear 70 is drivingly connected to the second gear 80 by the first transmission belt 66 which passes about the periphery of both the first gear 70 and the second gear 80. As mentioned before, the first gear 70 and the second gear 80 have teeth. The transmission belt 66 also has teeth that correspond and interlock in a sprocket-like manner with the teeth of the first and second gears 70, 80. Because the second gear 80 is integrally mounted to the second arm 40, the second arm 40 is pivoted with the second gear 80. The second gear 80, in cooperation with the first transmission belt 66, acts as a pulley to rotate the second arm 40 about the connecting rod 28. With this arrangement, when the first arm 20 pivots about the base 12 and thus about the first gear 70 in one direction, the first transmission belt 66 drives the second gear 80 to rotate about the connecting rod 28 in an opposite direction. (Similarly, if the second arm 40 is rotated in one direction about the connecting rod 28, the first transmission belt 66 drives the first arm 20 to rotate about the base 12 in the opposite direction.) Thus, if the first arm 20 pivots about the base 12 in a counterclockwise direction, the first transmission belt 66 drives the second gear 80 to pivot about the connecting rod 28 of the first arm 20 in a clockwise direction, and if the first arm 20 pivots about the base 12 in a clockwise direction, the first transmission belt 66 drives the second gear 80 to pivot about the connecting rod 28 in a counterclockwise direction.

In the preferred embodiment, it should be noted that the relationships between the first gear 70, the second gear 80 and the first transmission belt 66 are such that they drive the second arm 40 to pivot about the first arm 20 in such a way that the third axis C reciprocally moves along a same line which extends between the first and third axes, for any rotation of the first or second arms. Thus, for this embodiment, consider a line I—I' extending through the first axis A and through the third axis C to substantially bisect the frame 10 in the longitudinal direction of the frame. For all movement of first and second arms 20, 40, travel of the third axis C will remain on this line, and the third axis merely reciprocally moves toward and away from the stationary first axis A.

In this embodiment, this reciprocal motion within the same line occurs because the first arm 20 and the second arm 40 are of the same length. However, other gearing and belt arrangements which would provide for similar travel of the third axis C, even when the arm lengths are different, also could be contemplated by those of ordinary skill in the art, given this disclosure. When the first arm 20 and the second arm 40 are of the same length, as in the exemplary embodiment, it is noted that the second arm 40 rotates about the first arm 20 at twice the angular distance which the first arm 20 pivots about the base 12. That is, if the first arm 20 pivots 45° about the base 12 in a counterclockwise direction, the first belt 66 drives the second arm 40 to pivot 90° about the first arm 20 in the clockwise direction. Also, as the arms rotate from a retracted position to an extended position, the third axis C will move through the first axis A along line I—I'.

The second drive assembly 82 includes the third gear means 32 and the fourth gear means 52, mentioned earlier. Second drive assembly 82 participates in movement of carrier 50 in response to rotation of the second arm 40 about the first arm 20. The third gear 32 and the fourth gear 52 structures of the drive assembly 82 are drivingly connected by a second transmission belt 84 in the same fashion as the first gear 70 and the second gear 80 of the first 62 and second gear means 64. Preferably, the third gear means 32 includes a gear member 86 that is integrally mounted to the connecting rod 28 of the first arm 20. As such, this third gear 86 is stationary with respect to the connecting rod 28 and indeed the first arm 20 as whole, and is mounted such that the axis through the third gear coincides with the second axis B defined by the connecting rod. Fourth gear means 52 has a fourth gear 54 located on the upper portion thereof, just below where the upper portion of the fourth gear means 52 connects with the carrier 50. Fourth gear 54 therefore is concentric with, and rotatable about the third axis C.

As with the first drive assembly 60, the third gear 86 is drivingly connected to the fourth gear 54 by second transmission belt 84 which extends about the periphery of both of these gears. Likewise, the second transmission belt 84 has teeth which correspond and interlock with teeth on the third gear 86 and the fourth gear 54. Thus, when the second arm 40 pivots about the second axis B defined by the connecting rod 28 (and thus about the third gear 86) in one direction, the second transmission belt 84 drives the fourth gear 54 to pivot in an opposite direction about the third axis C. Similarly, if the carrier is rotated in one direction about the third axis C, the second transmission belt 84 drives the second arm 40 to rotate about the second axis B of the connecting rod 28 in the opposite direction.

By the second drive assembly 82, i.e., by the relationship between the third gear means 32, the fourth gear means 52 and the second transmission belt 84, the second transmission belt 84 will cause the carrier 50 to rotate about the third axis C such that the angular orientation of the carrier 50 relative to the drawer frame 14 and the base 12 is maintained. That is the carrier 50 does not rotate with respect to the base 12 and frame 14 as the first and second arms 20, 40 are pivoted to alternatively extend or retract the carrier 50. The resulting motion of the carrier 50 is reciprocal along line I—I', along with the third axis C. This is because the rotation of the first arm 20, the second arm 40, and the carrier 50 are interrelated by the first and second drive assemblies 60, 82 such that the first arm 20 cannot pivot about the base 12 without pivoting the carrier 50 about the second arm 40 in the same direction. By the same token, the carrier 50 could not pivot about the second arm 40 without causing the first arm 20 to rotate about the base 12 in the same direction. Thus, while rotation of the arms moves the carrier 50 toward and away from the base 12, the angular position of the carrier 50 relative to the base 12 and the frame 14 is constant and the carrier 50 has only linear motion with respect to the base 12. As such, to a customer using the drawer assembly of the present invention, the actual extending and retracting motion of the carrier 50 would appear to be the same as noted for conventional rail type drawers.

Figure 5:
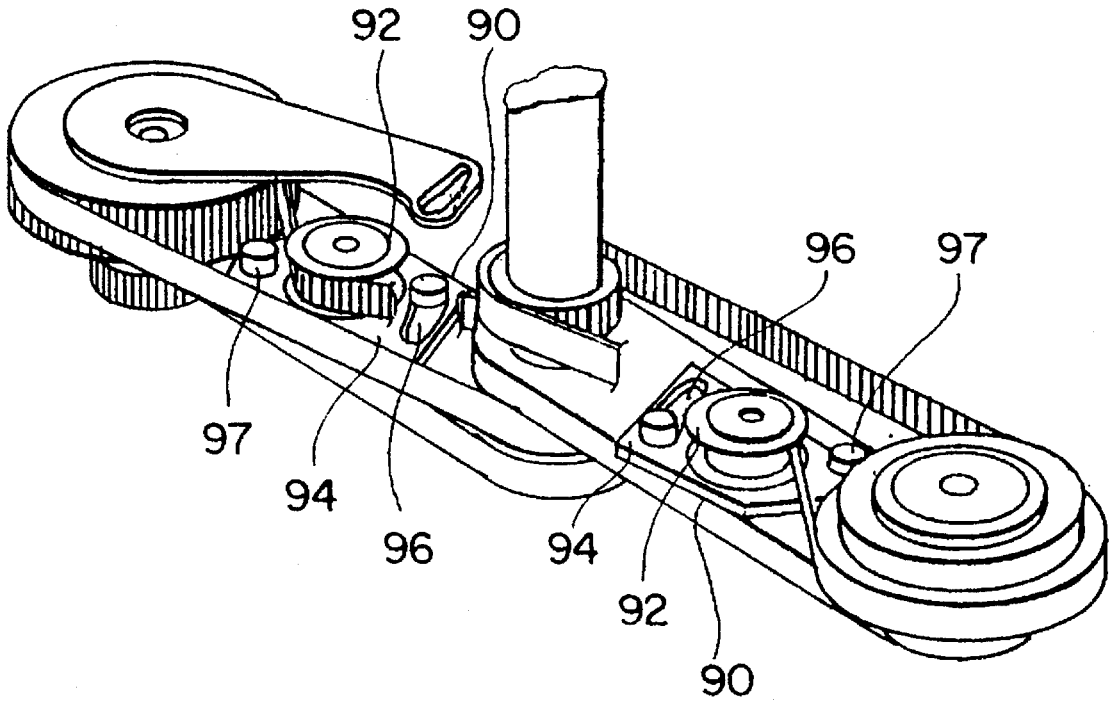
FIG. 5 is a view, similar to FIG. 2, of a preferred belt tension regulation assembly suitable for use with the transaction drawer mechanism of the present invention.

With particular reference now to FIG. 5, belt tension control means preferably are provided for controlling tension in the transmission belts. In the featured embodiments, two belt tension regulators 90 are shown, one associated with the first transmission belt 66, the other associated with the second transmission belt 84. In each regulator 90, the position of a pulley 92 determines belt tension because the pulleys contact the belts. In each regulator 90, pulley 92 is rotatably supported on a plate 94, with the plates being attached to the lower portion 26 of first arm 20 and to the second arm 40 as shown. Each plate 84 is adjustable with respect to the arm portion on which it is mounted. As seen from FIG. 5, each plate 94 has a slot 96 which receives a fastener and an opening (not shown) for receiving a second, same fastener 97. As is apparent, the fasteners of each regulator are selectively tightened or loosened to permit pivotal adjustment of plate 94 about the fastener 97 and therefore pulley 92 about an axis determined by the fasteners to effect tension adjustment in the belt in contact with pulley.

Figure 6A:
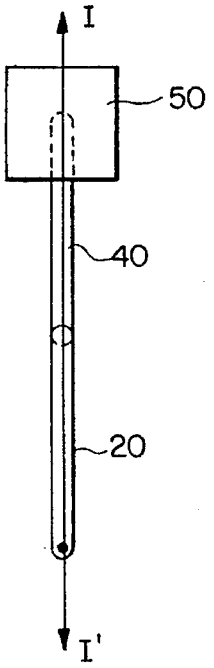
FIGS. 6A through 6D are useful in understanding relative movement of the arms and the carrier, with respect to each other, and with respect to the drawer frame.

In operation, the actual movement of the arms and the carrier will be discussed with reference to FIGS. 6A through 6D. In FIG. 6A, the first arm 20 and the second 40 arm are schematically shown as fully extended along line I—I' which, when the arms are so extended, passes through the first, second and third axes. In this position, the carrier 50 is in its fully retracted position, secure inside the drawer frame 14. When the carrier 50 is to be extended from the drawer frame 14 for access thereto, the first arm is rotated away from line I—I' in a counterclockwise direction. Since the second axis B is defined by the connecting rod 28 at the end portion 41 of the first arm, the second axis also moves away from line I—I'. As explained above, the first drive assembly 60 transmits pivotal motion of the first arm 20 to the second arm 40, thus driving the second arm 40 to pivot about the second axis B in a clockwise direction so that the first axis A and the third axis C remain on line I— I'. At the same time, the carrier 50 pivots about the second arm 40 by an angle equal to the rotation of the first arm 20 about the base 12, in both magnitude and direction.

Figure 6B:
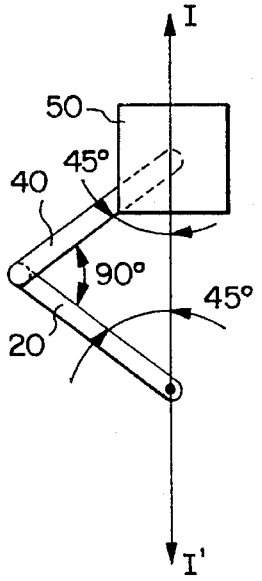
Figure 6C:
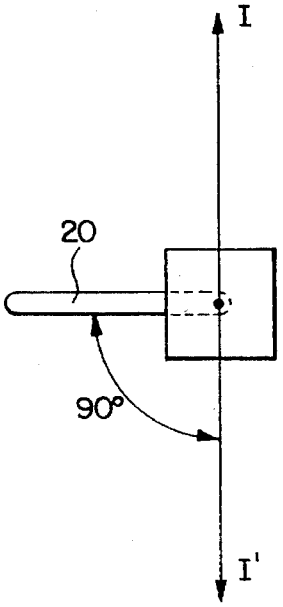

As shown in FIG. 6B, when the first arm 20 has rotated 45° away from line I—I', the second arm 40 has pivoted 90° about the second axis B on the first arm. Meanwhile, the carrier 50 has rotated 45° with respect to the second arm 40. As the first arm 20 continues to rotate, it reaches a position where it has rotated 90° away from line I—I' in a counterclockwise direction, as shown in FIG. 6C. At this point, the first drive assembly has pivoted the second arm 180° clockwise about the first arm 20. Where the second arm 40 initially had been fully extended from the first arm 20, in FIG. 6C, the second arm is now positioned between the upper and lower portions of the first arm. Also, the carrier 50 has rotated 90° in a counterclockwise direction relative to the second arm.

Figure 6D:
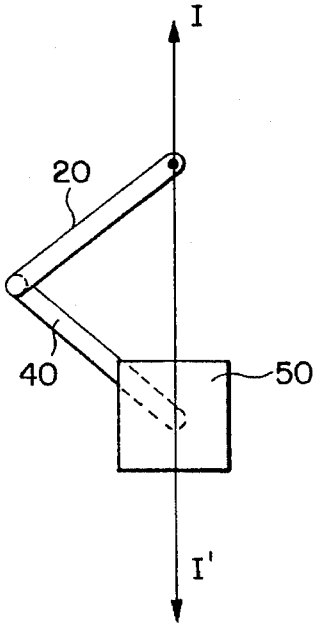

As the first arm 20 continues to rotate in a counterclockwise direction, it begins to move back toward line I—I' as shown in FIG. 6D. At the same time, the second arm 40 rotates about the first arm 20, advancing the third axis C and the carrier along line I—I'. All the while, the carrier 50 also pivots to maintain its orientation with respect to the frame 14. First and second arm movements continue until the arms are fully extended with all three axes falling along line I—I' and the carrier extending outward to be available for use by a customer. The entire process is then reversed to retract the carrier 50 within the drawer frame 14. Thus it is seen that the total displacement of carrier 50, along line I—I', from its fully retracted position to its fully extended position, is twice the length of each of arms 20, 40. Where arms 20 and 40 are of the same length, the displacement is four times the length of either one of the arms.

Figure 7:
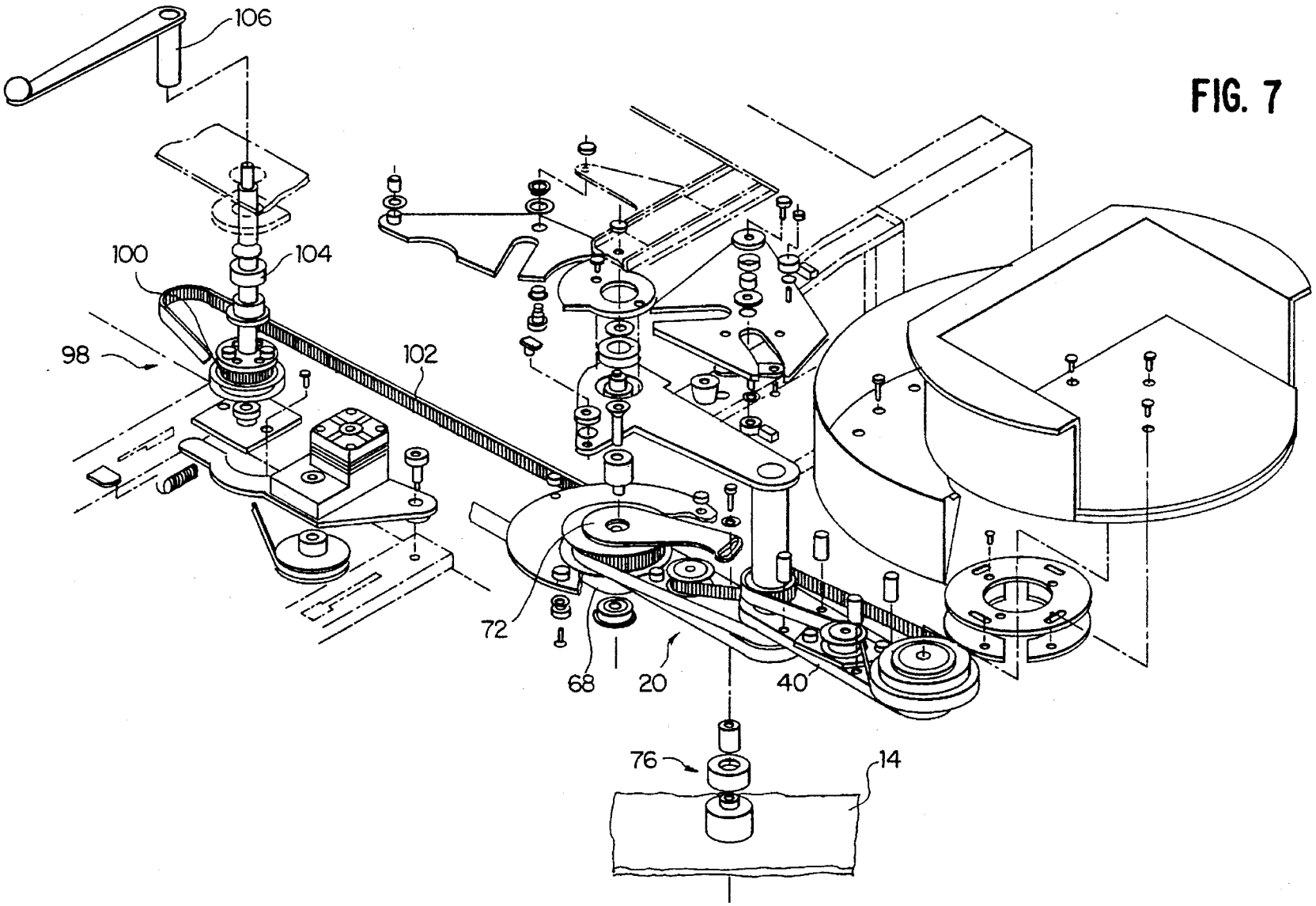
FIG. 7 is an exploded, perspective view illustrative of construction details of a commercial embodiment of a transaction drawer mechanism in accordance with the present invention.

In a preferred embodiment of the invention, the drawer mechanism is drivable by a motor 98, shown in FIG. 7. As mentioned earlier, the first gear means 62 includes a lower toothed gear 68, which is located below the first arm 20. Lower gear 68 is rigidly fixed to the first arm 20. This lower toothed gear 68 is connected to a toothed driving gear 100 of the motor 98 by a third transmission belt 102. Like the first and second transmission belts 66, 84, the third transmission belt 102 has teeth which interlock with the teeth of the driving gear 100 and the lower gear 68. Additionally it is preferred that a shaft 104 of the motor 98, connected to the driving gear, also be connected to a manual handcrank 106. This provides for alternative driving of the drawer mechanism 10, either by the motor 98 or the handcrank 106. As such, driving of lower gear 68 by either the motor 98 or handcrank 106 translates rotational motion of lower gear 68 to linear motion of carrier 50.

Because carrier 50 of the invention travels through the rotational motion of its arms, rather than a conventional slide mechanism, a transaction drawer according to the invention requires only approximately one-sixth the horsepower of other conventional transaction drawers to operate. Thus, a drawer according to the invention can easily be rotated by either operation of the motor 98 or the handcrank 106, via the third transmission belt 102 and the lower gear 68.

FIG. 7 also illustrates a complete transaction drawer according to a commercial embodiment of the invention. While each of the several individual connective and other components of the illustrated drawer has not been discussed in detail, one of ordinary skill in the art, from this disclosure, would readily appreciate how to make and use a transaction drawer according to this invention.

It is to be understood that there can be various changes and modifications to the preferred embodiments of the drawer mechanism of the present invention disclosed herein, which changes and/or modifications may be made by one of ordinary skill in the art, but would still result in a mechanism well within the scope of the invention as set forth in the claims.

We claim:

1. A drawer mechanism for supporting a movable carrier on a base comprising:

a first arm supported on said base for swinging movement about a first axis which is stationary with respect to said base;

a second arm supported on said first arm for swinging movement about a second axis, said second axis being stationary with respect to said first arm, spaced from said first axis, and substantially parallel to said first axis;

a carrier supported on said second arm for pivotal movement about a third axis, said third axis being stationary with respect to said second arm, spaced from said second axis, and substantially parallel to said second axis;

first drive means for controlling an angular position of said second arm relative to said first arm in respect to swinging movement of said first arm relative to said base; and second drive means for controlling an angular position of said carrier relative to said second arm in response to swinging movement of said second arm relative to said first arm, said angular positions having magnitudes and directions which maintain said carrier at a fixed angular orientation relative to said base throughout said swinging movement of said arms.

2. A drawer mechanism in accordance with claim 1, wherein a first angle of said swinging movement of said first arm relative to said base is equal in magnitude and opposite in direction with respect to a second angle of said swinging movement of said carrier relative to said second arm.

3. A drawer mechanism in accordance with claim 1, wherein a distance between said first axis and said second axis is equal to a distance between said second axis and said third axis.

4. A drawer mechanism in accordance with claim 1, wherein said first drive means includes a first gear which is concentric with said first axis and which is rigidly fixed to said base, a second gear which is concentric with said second axis and rigidly fixed to said second arm, and first transmission means drivingly connecting said first gear to said second gear.

5. A drawer mechanism in accordance with claim 4, wherein said gears are pulleys and said transmission means is a belt on said pulleys.

6. A drawer mechanism in accordance with claim 1, wherein said second drive means includes a third gear which is rigidly fixed to said first arm, a fourth gear which is rigidly fixed to said carrier, and a second transmission means drivingly connecting said third gear to said fourth gear.

7. A drawer mechanism in accordance with claim 6, wherein said gears are pulleys and said second transmission means is a belt on said pulleys.

8. A drawer mechanism in accordance with claim 1, wherein collective action of said first and second drive means causes said third axis to travel in a same linear path throughout swinging movement of said arms.

9. A drawer mechanism in accordance with claim 8, wherein collective action of said first and second drive means causes said third axis to pass through said first axis during swinging movement of said arms.

10. A drawer mechanism for supporting a movable carrier on a base comprising:

a base;

a carrier which is supported on said base, said carrier being movable relative to said base from a retracted position to an extended position;

a plurality of arms which support said carrier on said base, said arms being pivotally connected together in series, said arms including at least a base arm and a carrier arm, said base arm being supported on said base for swinging movement about a first axis which is stationary on said base, said carrier arm including means for supporting said carrier for pivotable movement about a carrier pivot axis which is stationary on one of said carrier arms and is parallel to said first axis;

position-controlling means for maintaining said carrier axis in a reference plane, said reference plane being stationary with respect to said base and being, throughout movement of said carrier from its retracted position to its extended position, defined by said first axis and said carrier axis;

said position controlling means including a base gear which is concentric with said first axis and which is rigidly fixed to said base, a carrier gear which is concentric with said carrier pivot axis and is rigidly fixed to said carrier, and transmission means connecting said base gear to said carrier gear for rotating said carrier gear in response to pivotal movement of said arms, so as to maintain said carrier means at a constant orientation relative to said reference plane.

11. A drawer mechanism in accordance with claim 10, wherein a first angle of said swinging movement of said base arm relative to said base is equal in magnitude and opposite in direction with respect to a second angle of said swinging movement of said carrier relative to said carrier arm.

12. A drawer mechanism in accordance with claim 10, wherein said carrier gear and said transmission means operate to provide said carrier with a constant rate of swinging movement relative to said carrier arm.

13. A drawer mechanism in accordance with claim 10, wherein said base gear and said transmission means operate to provide said base arm with a constant rate of swinging movement relative to said base.

14. A drawer mechanism in accordance with claim 10, wherein said transmission means causes said carrier arm to move past said base arm when said carrier is moved relative to said base from said retracted position to said extended position.

15. A drawer mechanism in accordance with claim 10, wherein said carrier axis passes through said first axis.

16. A drawer mechanism in accordance with claim 10, wherein said carrier arm is supported on said base arm for swinging movement about a second axis which is stationary with respect to said base arm, spaced from said first axis, and substantially parallel to said first axis.

17. A drawer mechanism in accordance with claim 16, wherein said transmission means causes said carrier arm to swing past said base arm when said carrier is moved relative to said base from said retracted position to said extended position.

18. A drawer mechanism in accordance with claim 16, wherein a distance between said first axis and said second axis is equal to a distance between said second axis and said carrier axis.

19. A drawer mechanism in accordance with claim 18, wherein, in a reference plane which is normal to said axes, point A is a point on said first axis, B is a point on said second axis, and C is a point on said carrier axis, and angle CAB equals angle ACB throughout swinging movement of said axis.

20. A transaction drawer mechanism comprising:

a frame including a base portion;

a carrier which has a retracted position wherein said carrier is secure within said frame, and which is extendible from said frame;

a first arm supported on said base portion for swinging movement about a first axis which is stationary with respect to said base;

a second arm supported on said first arm for swinging movement above a second axis, said second axis being stationary with respect to said first arm, spaced from said first axis, and substantially parallel to said first axis;

said carrier being supported on said second arm for pivotal movement about a third axis, said third axis being stationary with respect to said second arm, spaced from said second axis, and substantially parallel to said second axis;

first drive means for controlling an angular position of said second arm relative to said first arm in respect to swinging movement of said first arm relative to said base portion; and second drive means for controlling an angular position of said carrier relative to said second arm in response to swinging movement of said second arm relative to said first arm, said angular positions having magnitudes and directions which maintain said carrier at a fixed angular orientation relative to said base portion and said frame throughout said swinging movement of said arms.

21. A drawer mechanism in accordance with claim 20, wherein a first angle of said swinging movement of said first arm relative to said base is equal in magnitude and opposite in direction with respect to a second angle of said swinging movement of said carrier relative to said second arm.

22. A drawer mechanism in accordance with claim 21, wherein a distance between said first axis and said second axis is equal to a distance between said second axis and said third axis.

23. A drawer mechanism in accordance with claim 20, wherein said first drive means includes a first gear which is concentric with said first axis and which is rigidly fixed to said base, a second gear which is concentric with said second axis and rigidly fixed to said second arm, and first transmission means drivingly connecting said first gear to said second gear; and wherein said second drive means includes a third gear which is rigidly fixed to said first arm, a fourth gear which is rigidly fixed to said carrier, and a second transmission means drivingly connecting said third gear to said fourth gear.

24. A drawer mechanism in accordance with claim 23, wherein said gears are toothed gear members and said first and second transmission means each include a belt on said gear members.

25. A drawer mechanism in accordance with claim 23, wherein said first arm includes an upper portion, a lower portion, and a connecting portion which joins said upper and lower portions to provide said first arm with a U-shape, and wherein said second arm includes an elongate plate having an opening through which said connecting portion extends to pivotably attach said second arm to said first arm.

26. A drawer mechanism in accordance with claim 23, wherein said mechanism includes an adjustment arm for selectively fixing said first gear to said base.

27. A drawer mechanism in accordance with claim 23, wherein said first arm further includes a fifth gear rigidly attached thereto for transmitting rotational motion for driving of said first arm.

* * * * *